United States Patent [19]

Takeda

[11] 4,053,018

[45] Oct. 11, 1977

[54] AUTOMATIC CONTROL SYSTEM FOR EARTH-MOVING EQUIPMENT

[75] Inventor: Tashiro Takeda, Kanagawa, Japan

[73] Assignee: Kabushiki Kaisha Komatsu Seisakusho, Tokyo, Japan

[21] Appl. No.: 653,787

[22] Filed: Jan. 30, 1976

Related U.S. Application Data

[62] Division of Ser. No. 472,279, May 22, 1974, Pat. No. 3,957,121.

[30] Foreign Application Priority Data

May 28, 1973 Japan ..... 48-59521
May 29, 1973 Japan ..... 48-63079[U]

[51] Int. Cl.[2] ..... E02F 3/76
[52] U.S. Cl. ..... 172/4.5; 172/779
[58] Field of Search ..... 172/4.5, 2, 3, 7, 9, 172/4, 12, 779

[56] References Cited

U.S. PATENT DOCUMENTS

| | | | |
|---|---|---|---|
| 2,654,301 | 10/1953 | Bohmker | 172/2 |
| 3,251,422 | 5/1966 | Allgaier et al. | 172/4 |
| 3,497,014 | 2/1970 | Ask | 172/4.5 |
| 3,556,225 | 1/1971 | Matsuzaki | 172/4.5 |
| 3,776,322 | 12/1973 | Misch et al. | 172/2 |
| 3,831,683 | 8/1974 | Ikeda | 172/4.5 |
| 3,957,121 | 5/1976 | Takeda | 172/4.5 |

*Primary Examiner*—George J. Marlo
*Attorney, Agent, or Firm*—Spensley, Horn and Lubitz

[57] ABSTRACT

The cutting angle or cutting depth of the blade of an earth-moving equipment such as a bulldozer is adjusted by a hydraulic pressure cylinder and the supply of pressurized liquid to and from the hydraulic pressure cylinder is controlled in accordance with the running speed of the bulldozer. In addition, the rate at which the cutting depth of the blade of the earth-moving equipment is adjusted is inversely proportional to the speed of the earth-moving equipment.

4 Claims, 2 Drawing Figures

AUTOMATIC CONTROL SYSTEM FOR EARTH-MOVING EQUIPMENT

This is a division of application Ser. No. 472,279, now Pat. No. 3,957,121, filed May 22, 1974.

BACKGROUND OF THE INVENTION

This invention relates to an automatic control system of an earth-moving equipment, and more particularly, to a control system of the blade of a bulldozer.

When using a bulldozer in an earth-moving work it is necessary to maintain its blade at a desired cutting angle with respect to the ground surface so as to level the ground as desired without overloading the bulldozer. According to one proposed system, a reference plane is established by using a laser beam or the like and the blade is controlled to follow the reference plane.

According to such a prior art system, however, when an overload condition is encountered, a phenomenon which is termed by experts as stall phenomenon occurs in which although the engine of the bulldozer is operating no torque is transmitted to the load side, thus interrupting the operation of the machine. Accordingly, it is necessary to avoid an excessively large cutting angle of the blade that causes overloading. On the other hand, if the cutting angle is too small, the working effeciency of the bulldozer will be low.

Another problem encountered in the operation of a bulldozer involves the cutting depth of the blade. If the cutting depth is too large this will also cause overloading. An ON-OFF control system has been used to control the cutting depth of the blade. In order to stabilize such a control system it has been the practice to increase the width of the insensitive zone of the control system that determines the accuracy of the earth moving work or to decrease the operating speed of a hydraulic pressure cylinder that drives the blade. To increase the accuracy of the earth moving work or to level the ground at a high degree of flatness it is necessary to sufficiently decrease the operating speed of the hydraulic pressure cylinder and hence the running speed of the earthmoving equipment, otherwise a stable control system could not be obtained. On the other hand where rough levelling is permissible, or where a high degree of accuracy is not required, the width of the insensible zone may be increased. Under these conditions it is possible to increase the operating speed of the hydraulic pressure cylinder and hence the running speed of the equipment.

Summary of the Invention

Accordingly, it is an object of this invention to provide an improved control system of an earth moving equipment capable of avoiding an excessively large cutting angle of the blade thereof.

Another object of this invention is to provide an improved control system of an earth-moving equipment capable of avoiding an excessively large cutting depth of the blade thereof.

A further object of this invention is to provide a novel automatic control system for the blade of a bulldozer capable of levelling the ground surface without overloading the engine mounted on the bulldozer.

According to this invention there is provided an automatic control system for an earth-moving equipment comprising a working member operated to dig the ground, control means for varying the position of the working member relative to the ground surface, and means responsive to the running speed of the earth-moving equipment for controlling the operation of the control means.

In one embodiment of the invention, the earth-moving equipment comprises a bulldozer including an engine connected to the running wheels thereof through a torque converter and a blade supported by an arm pivotally mounted on the stationary portion of the bulldozer, the control means comprises a fluid pressure cylinder for rotating the arm thereby to vary the cuttng angle of the blade relative to the ground surface and an electromagnetic switching valve for controlling the pressurized liquid supplied to and exhausted from the cylinder, and the means responsive to the running speed comprises a detector for detecting the ratio between the numbers of revolutions of the input and output shafts of the torque converter, and a comparator for comparing the output from the detector with a predetermined reference value so as to produce an output which is used to operate the electromagnetic switching valve.

According to a modified embodiment of this invention, the earth-moving equipment comprises a bulldozer including a blade, the control means comprises a hydraulic pressure cylinder for raising and lowering the blade thereby varying the cutting depth thereof and an electromagnetic switching valve for controlling the pressurized liquid supplied to and exhausted from the hydraulic pressure cylinder and a flow control valve located between the switching valve and the hydraulic pressure cylinder, and the means responsive to the running speed comprises a speed detector responsive to the running speed of the bulldozer running over the ground surface, and means responsive to the output from the speed detector for controlling the flow rate of the pressurized liquid flowing through the flow control valve.

BRIEF DESCRIPTION OF THE DRAWINGS

The invention can be more fully understood from the following detailed description taken in conjunction with the accompanying drawings in which.

DESCRIPTION OF THE PREFERRED EMBODIMENTS

Figure 1:
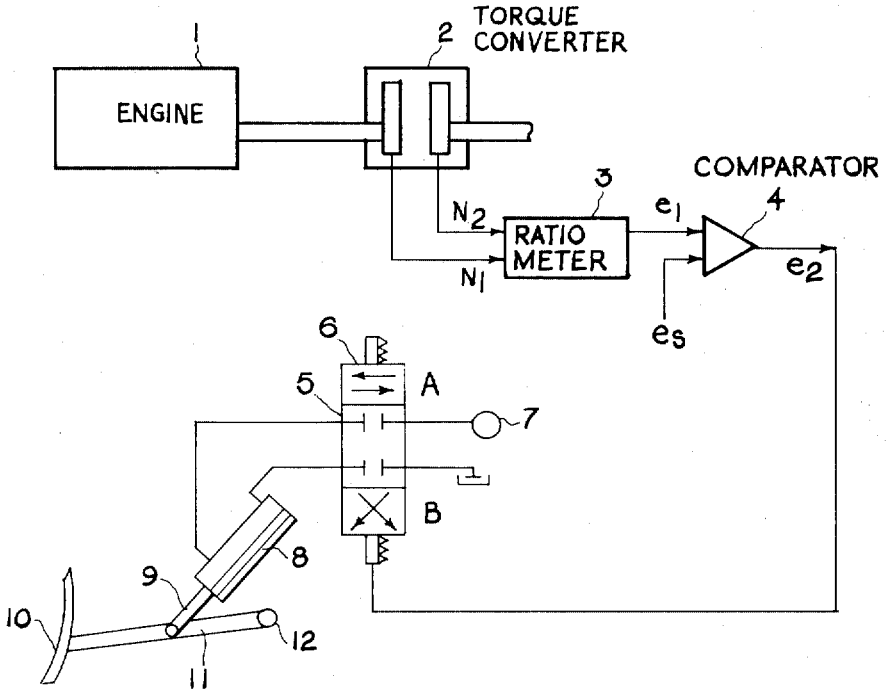
FIG. 1 shows a connection diagram of one embodiment of the inventive control system designed to control the cutting angle of the blade of a bulldozer and FIG. 2 shows a connection diagram of a modified embodiment of this invention designed to control the cutting depth of the blade of a bulldozer.

Referring now to FIG. 1 of the accompanying drawings, prime mover 1, for example an internal combustion engine, is 2 connected to driving wheels or catapillers, not shown, of a bulldozer through a torque converter 2, preferably of the type including a pump and a turbine and wherein the torque transmitted can be varied by varying the quantity of the operating liquid, a clutch and a transmission gearing, not shown. The blade 10 of the bulldozer is supported by an arm 11 which is pivotally mounted on a shaft 12 provided for the stationary portion of the bulldozer. The arm 11 is connected at an intermediate point thereof to a piston rod 9 of a liquid pressure cylinder 8 mounted on the stationary portion so that by the operation of the cylinder 8, the cutting angle of the blade 10 can be varied.

The hydraulic pressure cylinder 8 is controlled by a hydraulic pressure control device 6 including a source of pressurized liquid, for example a pump 7 and an electromagnetically operated three-way switching valve 5.

Thus, as the electromagnet, not shown, is energized by a positive or negative signal, the valve 5 is switched between conditions A and B so as to supply and exhaust pressurized liquid into and out of the cylinder 8. Accordingly, the angle of the arm 11 and hence the blade 10 with respect to the ground surface can be varied.

According to this invention the numbers of revolutions $N_1$ and $N_2$ of the input and output shafts respectively of the torque converter 2 are detected by suitable electric means, and signals corresponding to $N_1$ and $N_2$ are applied to a ratio meter 3. The output $e_1$ from the ratio meter 3 is compared with a reference value $e_r$ by means of a comparator 4 so that an output $e_2$ is produced whenever output $e_1$ is smaller than the reference value $e_r$. Output $e_2$ is applied to the electromagnetic three-way switching valve 5 to switch it to condition A. Then the pressurized liquid from the source 7 is admitted into the lower chamber of cylinder 8 whereas the pressurized liquid in the upper chamber of cylinder 8 is drained so that the piston rod 9 is retracted to turn arm 11 in the clockwise direction thereby decreasing the cutting angle of the blade 10. Accordingly, the load on the blade is decreased to increase the ratio of the numbers of revolutions $N_1 : N_2$ of the input and output shafts of the torque converter 2. As the ratio $N_1 : N_2$ increases, the comparator 4 ceases to produce output $e_2$ thus bringing the switching valve 5 to its neutral position in which connections between the cylinder 8, and source 7 and the drain are interrupted. Accordingly, the arm and the blade will be held in their adjusted positions.

When the load on the blade decreases further, the polarity of the output $e_2$ is reversed, so that the valve 5 will be switched to condition B. Accordingly, the pressurized liquid from source 7 is admitted into the upper chamber of cylinder 8 while the lower chamber thereof is drained thus rotating the arm 11 in the counterclockwise direction. In this manner, the cutting angle of the blade 10 is increased until the output $e_2$ is reduced to zero, and the bulldozer operates with its blade adjusted to this position. Adjustment of the blade 10 is done while the bulldozer is running. In other words, depending upon whether the ground to be worked is relatively soft or hard, the cutting angle of the blade is varied automatically without causing any overload and stall of the engine 1.

Figure 2:
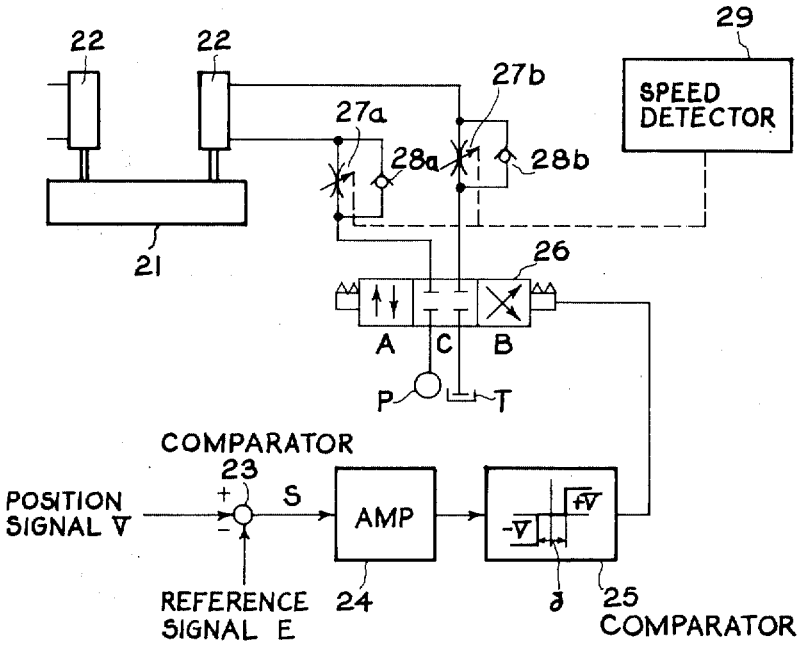

In the modified embodiment of this invention illustrated in FIG. 2, the cutting depth of the blade 21 of a civil machine, such as a bulldozer, is adjusted by the operation of the control system embodying the invention. The blade 21 is moved in the vertical direction by means of hydraulic pressure cylinders 22 provided on the opposite ends thereof thus varying the cutting depth of the blade 21. The position or depth of the blade 21 cutting into the ground is detected by a suitable position detector, not shown, and a position signal V produced by the detector is compared with a reference signal E which represents a predetermined position by a comparator 23. The difference signal S produced by comparator 23 is amplified by an amplified 24 and the output from the amplifier 24 is applied to another comparator 25 having an insensitive zone $\ominus$ ranging from $+\frac{1}{2}\delta$ to $-\frac{1}{2}\delta$ and determined in accordance with the type of the operation of the earth-moving equipment. Thus, so long as the amplitude of the output from amplifier 24 falls in this zone, no output will be produced by the comparator 25, and only when the magnitude of the amplifier output exceeds this range, the comparator produces a positive or negative output V depending upon the polarity of the difference signal S. The output V from the comparator 25 is applied to an electromagnetic three-way switching valve 26 identical to switching valve 5 shown in FIG. 1. Upon application of the output V of one polarity the switching valve 26 is switched to condition A whereby the pressurized liquid from pump P is admitted into the lower chamber of cylinder 22 via an electromagnetic flow control valve 27*a* whereas the pressurized liquid in the upper chamber of cylinder 22 is drained into a reservoir tank T via a similar electromagnetic flow control valve 27*b* thus raising the blade 21. Where an output V of the opposite polarity is applied, the switching valve 26 is switched to condition B so as to admit the pressurized liquid into the upper chamber of cylinder 22 and to drain the pressurized liquid from the lower chamber of cylinder 22 respectively through flow control valves 27*b* and 27*a* whereby the blade 21 is lowered to increase the cutting depth. Where the comparator 25 does not produce any output, the switching valve 26 will be maintained at a neutral position C.

The electromagnetic flow control valves 27*a* and 27*b* are shunted by check valves 28*a* and 28*b* respectively, and are controlled by a control signal generated by a running speed detector 29 which electrically detects the running speed of the earth-moving machine on the ground such that the flow quantities through flow control valves are controlled in inverse proportion to the running speed. In other words, the speed of raising or lowering the blade 21 is decreased as the running speed is increased thus protecting the same against an excessive load.

Since it is possible to predetermine an appropriate running speed in accordance with the width $\delta$ of the insensitive zone, the operator of the earth-moving equipment is permitted to predetermine the width $\delta$ of the insensitive zone of the comparator 25 in accordance with the degree of flatness of the levelled ground surface and to select a running speed appropriate to the preset width $\delta$. With these adjustments, the operating speed of the hydraulic pressure cylinder 22 will be controlled in accordance with the running speed, thereby improving the operating efficiency of the earth-moving machine without overloading the blade.

For the sake of simplicity, only one of the control circuit for the hydraulic pressure cylinders 22 has been shown. It should be understood, however, that an identical control circuit is also provided for the other and that only one cylinder may be sufficient for certain types of the equipment.

Further, it should be understood that the invention can also be applied to other earth-moving eqiupment than a bulldozer, such as a motor grader having a blade at an intermediate point, a shovel loader or the like.

What is claimed is:

1. An automatic control system disposed in earthmoving equipment comprising:

an earth-moving vehicle having an earth-moving blade coupled thereto;

a pressure cylinder means coupled to said blade for raising and lowering the cutting depth thereof;

a switching valve coupled to said pressure cylinder means for selectively activating said cylinder means;

a first comparator means coupled to said switching valve, said comparator means for comparing the actual blade depth with a predetermined depth and for selectively activating said switching valve thereby causing said blade depth to readjust into said predetermined depth; and a speed detector coupled to said cylinder means, said detector for determining the running speed of said vehicle and for selectively regulating said pressure cylinder means such that the rate at which said blade is raised or lowered is inversely proportional to the running speed of said vehicle.

2. The control system of claim 1 wherein in addition thereto, a second comparator means is coupled to said first comparator means, said second comparator means for regulating the sensitivity of said first comparator means in accordance with the degree of flatness of the ground surface.

3. The control system of claim 2 wherein said switching valve is coupled to a pressurized liquid source for selectively activating said pressure cylinder means.

4. An automatic control system for earth-moving equipment comprising:

an earth-moving blade;

a pressure cylinder means coupled to said blade for raising and lowering the cutting depth thereof;

a switching valve coupled to said pressure cylinder means for selectively activating said pressure cylinder means;

a first comparator means coupled to said switching valve, said comparator means for comparing the actual blade depth with a predetermined depth and for selectively activating said switching valve thereby causing said blade depth to readjust into said predetermined depth;

a speed detector for generating a signal which corresponds to the speed of the earth-moving equipment; and a throttle valve means provided between said switching valve and said pressure cylinder, said throttle valve means being inversely responsive to said signal generated by said speed detector whereby the rate at which said blade is raised or lowered is inversely proportional to the running speed of the earth-moving equipment.

* * * * *